US006758306B2

(12) United States Patent
Walls et al.

(10) Patent No.: US 6,758,306 B2
(45) Date of Patent: Jul. 6, 2004

(54) CONSTRUCTION SAFETY SCREEN SYSTEM

(76) Inventors: Jason D. Walls, 3580 14th St. North, Naples, FL (US) 34103; Johnny A. Davis, 24377 Rodas Dr., Bonita Springs, FL (US) 34135

( * ) Notice: Subject to any disclaimer, the term of this patent is extended or adjusted under 35 U.S.C. 154(b) by 0 days.

(21) Appl. No.: 09/983,573

(22) Filed: Oct. 24, 2001

(65) Prior Publication Data

US 2003/0075385 A1 Apr. 24, 2003

(51) Int. Cl.[7] ..... A62B 1/22
(52) U.S. Cl. ..... 182/138; 182/82
(58) Field of Search ..... 52/202, 107, 203, 52/699, 714; 160/104, 368.1, 90; 182/138, 137, 139; 297/452.1; 482/27

(56) References Cited

U.S. PATENT DOCUMENTS 2,605,828 A * 8/1952 Lang ..... 160/368.1 X
3,480,069 A 11/1969 Handwerker
3,805,816 A 4/1974 Nolte
4,210,191 A * 7/1980 Li ..... 160/368.1 X
4,815,562 A 3/1989 Denny et al.
4,875,549 A 10/1989 Denny et al.
4,986,389 A 1/1991 Halligan, Sr. et al.
5,358,025 A * 10/1994 Wood ..... 160/368.1
5,582,266 A 12/1996 Rexroad et al.
6,068,085 A 5/2000 Denny et al.
6,182,790 B1 2/2001 Denny et al.
6,296,041 B1 * 10/2001 Cicero ..... 160/368.1
6,305,310 B1 * 10/2001 Ferri ..... 182/138

* cited by examiner

*Primary Examiner*—Hugh B. Thompson, II
(74) *Attorney, Agent, or Firm*—Edward M. Livingston, P.A.

(57) ABSTRACT

A construction safety screen (1) has structural capacity to wall predetermined portions of or entire worker-area precipices which include apertures and edges of under-construction buildings and scaffolding against accidental falling. Included are a fastening border (7), fasteners (12, 13, 14, 28, 43), netting apertures (5), netting material (6), visibility coloring and size adaptors. It can be rolled up for light-weight shipping or storage and unrolled easily and conveniently for use and reuse.

12 Claims, 12 Drawing Sheets

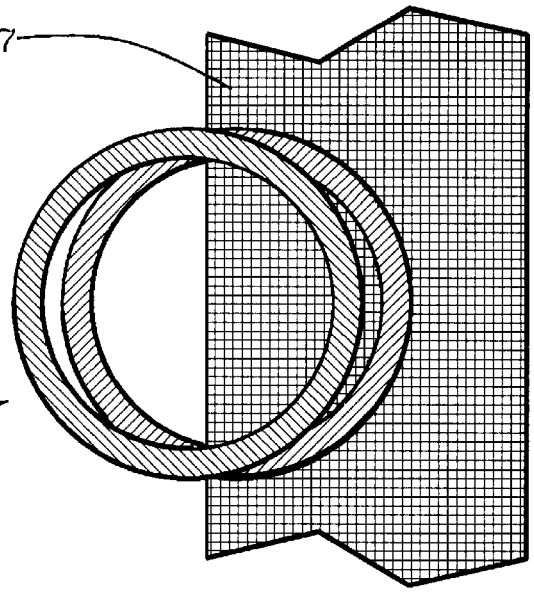
FIG. 9
FIG. 10
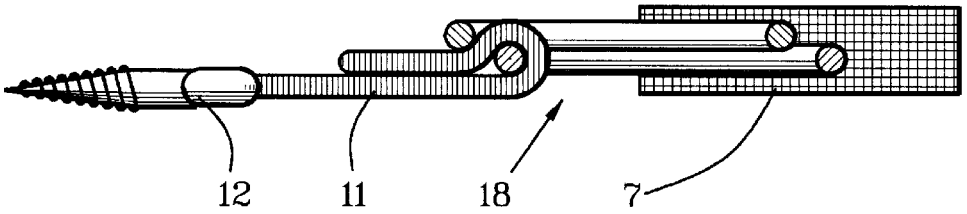
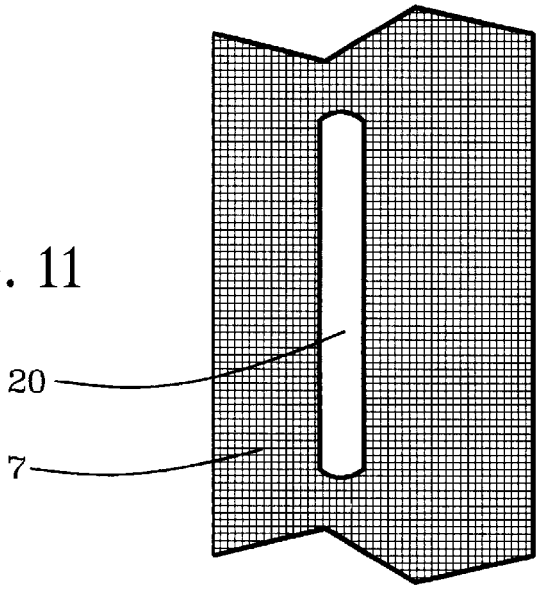
FIG. 11
FIG. 12
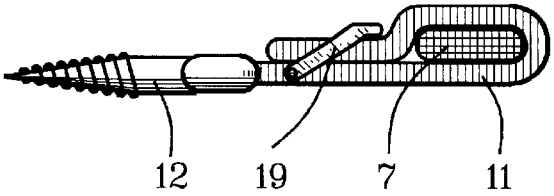

CONSTRUCTION SAFETY SCREEN SYSTEM

BACKGROUND OF THE INVENTION

This invention relates to safety screens to prevent workers from falling from edges of building-construction precipices that include stair wells, elevator shafts, windows, balconies and from other high edges and openings in buildings under construction and with scaffolding used in performing exterior work thereon.

Safety barriers and nets to prevent workers from falling into stair wells, into elevator shafts, out of windows and from other high portions of buildings under construction or scaffolding are known. None are known, however to have opening-height closure, restraint reliability and cost-effectiveness in a manner taught by this invention.

Examples of most-closely related known but different restraints against accidental falling from construction precipices are described in the following patent documents:

| U.S. Pat. No. | Inventor | Issue Date |
|---|---|---|
| 6,068,085 | Denny, et al. | May 30, 2000 |
| 6,182,790 | Denny, et al. | Feb. 6, 2001 |
| 5,582,266 | Rexroad, et al. | Dec. 10, 1996 |
| 4,815,562 | Denny, et al. | Mar. 28, 1989 |
| 4,875,549 | Denny, et al. | Oct. 24, 1989 |
| 3,480,069 | Handwerker | Nov. 25, 1969 |
| 3,805,816 | Nolte | Apr. 23, 1974 |
| 4,986,389 | Halligan, Sr., et al. | Jan. 22, 1991 |

Currently at building precipices, two-by-four boards nailed about forty-two inches high is the most common prevention against accidental falling into stair wells, into elevator shafts, out of windows and from other high portions of buildings under construction. Other known restraints against falling, such as described in the above prior art have not been adopted for effective use in the construction industry. An urgent need remains for effective building-precipice fall protection.

SUMMARY OF THE INVENTION

Objects of patentable novelty and utility taught by this invention, therefore, are to provide a construction safety screen which:

- closes entire worker-area openings and precipices of construction buildings and scaffolding as appropriate to prevent accidental falling therefrom;
- allows working ventilation and visibility;
- can be put in place for temporary use and removed quickly and conveniently;
- can be stored and reused;
- can be customized for construction-precipice features;
- is readily visible;
- can be positioned inwardly from, in line with or outside of edges of building precipices;
- can be tilted outwardly and upwardly to catch individuals who fall from work on or near outsides of buildings;
- is reliable, sturdy and long-lasting; and
- is cost-effective.

This invention accomplishes these and other objectives with a construction safety screen having structural capacity to screen predetermined portions of or entire worker-area openings and other precipices of under-construction buildings and scaffolding against individuals accidentally falling therefrom. The construction safety screen includes a fastening border, building-structure fasteners, netting apertures, visibility coloring, size adaptors and buckles, base rods, net struts, framework and guys. The net can be rolled up for light-weight shipping or storage and unrolled easily and conveniently for use and reuse.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

FIG. 9 is a fragmentary view of a double-ring buckle on a fastening border as an optional buckle for adjusting length of a fastening line to the eye bolt;

FIG. 10 is a partially cutaway side view of the double-ring buckle with the attachment line attached to the eye bolt;

FIG. 11 is a fragmentary side view of the fastening border with a strap orifice for optional use of a predetermined standard belt buckle for attaching the eye bolt to the attachment line;

FIG. 12 is a partially cutaway side view of the fastening border with the strap orifice for optional use of the standard belt buckle for attaching the eye bolt to the attachment line;

DESCRIPTION OF PREFERRED EMBODIMENT

Listed numerically below with reference to the drawings are terms used to describe features of this invention. These terms and numbers assigned to them designate the same features throughout this description.

Figure 1:
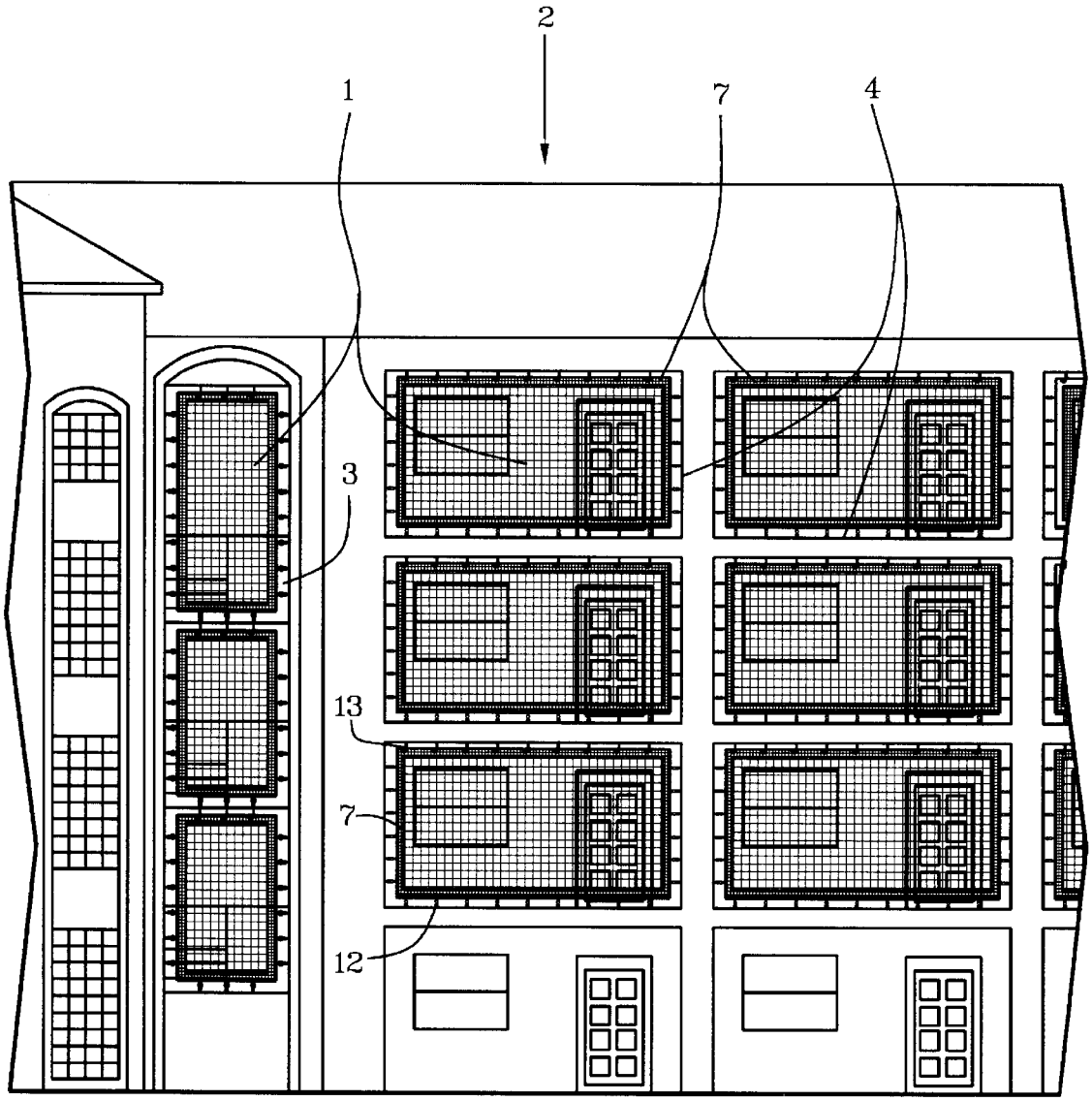
FIG. 1 is a partially cutaway front elevation view of a multi-story apartment building under construction with the construction safety screen positioned at edges of precipices that include stairways, and balconies.
Figure 2:
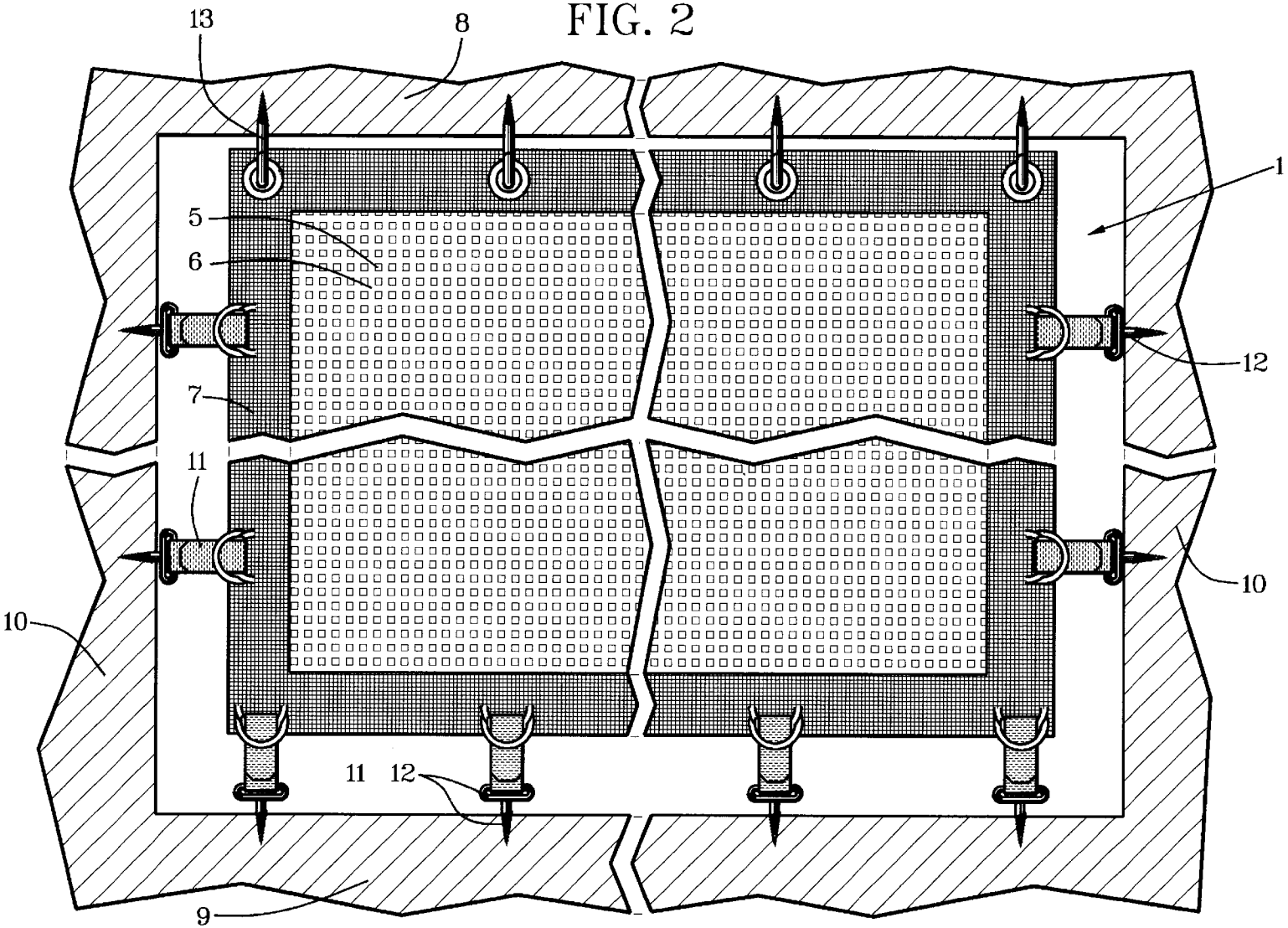
FIG. 2 is a partially cutaway enlarged view of the construction safety screen positioned in place in a building aperture.
Figure 3:
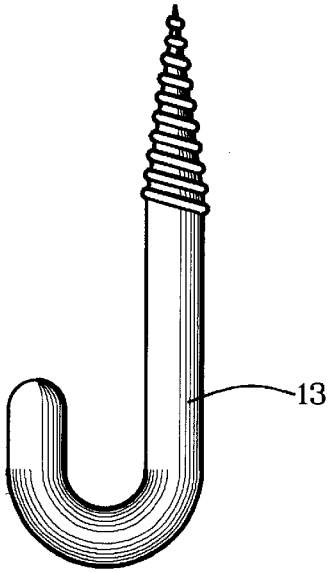
FIG. 3 is a side view of a straight hook bolt for hanging the construction safety screen to a top of a precipice framework.
Figure 4:
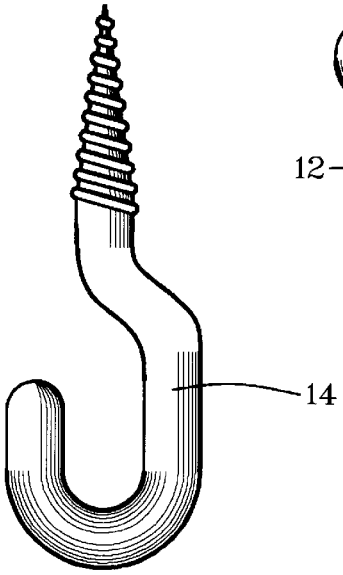
FIG. 4 is a side view of a centered hook bolt for hanging the construction safety screen to the top of the precipice framework.
Figure 5:
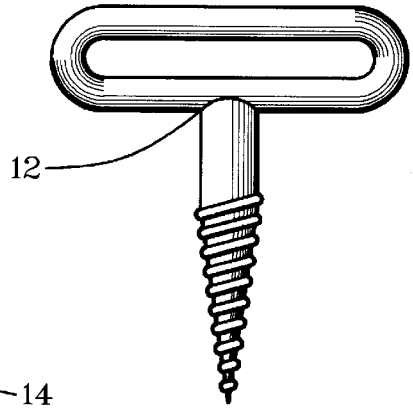
FIG. 5 is a side view of an eye bolt for anchoring the construction safety screen to a bottom of the precipice framework.
Figure 5:
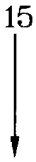

1. Construction safety screen
2. Building under construction
3. Stairwell
4. Balcony
5. See-through aperture
6. Netting material
7. Fastening border
8. Precipice top
9. Precipice bottom
10. Precipice sides
11. Attachment line
12. Eye bolt
13. Hook bolt
14. Centered Hook bolt
15. Fastener socket
16. Fastener bay
17. Socket-wrench connection
18. Double-ring buckles
19. Flat-strap buckles
20. Strap orifice
21. Quick-disconnect line
22. Quick disconnection
23. Quick-disconnection eyes
24. Double-point ratchets
25. Ratchet hooks
26. Outward-tension member
27. Closure inclines
28. Base rod
29. Precipice floor
30. Edge end
31. Anchor end
32. Precipice edge
33. Floor-anchor position
34. Net strut
35. Frame bottom
36. Frame top
37. Guy
38. Hinge
39. Adjustable fastening strap
40. Net border generally
41. Box stitching
42. Adjustable buckle
43. Swivel snap ring
44. Netting
45. Horizontal reinforcement straps
46. Vertical reinforcement strap
47. Intermediate section of horizontal reinforcement strap
48. Bottom border
49. Top border
50. Side border
51. Scaffold staging ends
52. Straps
53. Snap rings
54. Netting
55. Border Referring to FIGS. 1–2 a construction safety screen 1 is sized and shaped to screen a portion of a precipice of a building 2 under construction, the precipice including a stairwell 3 and a balcony 4. The construction safety screen 1 includes see-through apertures 5 that preferably are two-to-six-inches square to screen against passage of a human body and surrounded by netting material 6 having strength to support weight of the human body predeterminedly to prevent individuals from falling from the precipice.

The construction safety screen 1 includes a fastening border 7 for fastening it to building-structure fasteners that are attached detachably to predetermined building structure which can include a precipice top 8 a precipice bottom 9 and precipice sides 10 that can be building-aperture walls and optionally structural members thereat. Attachment lines 11 having adjustable length are extended intermediate an eye bolt 12 and the fastening border 7 at the precipice bottom 9 and at the precipice sides 10. A hook bolt 13 is used to hang the construction safety screen 1 from the precipice top 8.

Referring to FIGS. 1–7, the eye bolt 12 and the hook bolt 13 can be structured designedly for sizes and shapes of attachment lines 11 and for centering with a centered hook bolt 14.

Figure 6:
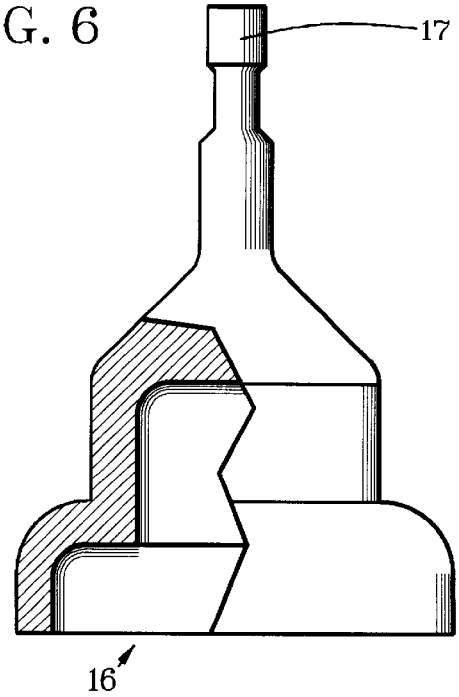
FIG. 6 is a partially cutaway side view of a fastener socket for screwing the hook bolt and the eye bolt into and out from construction framework that can include concrete, wooden and other bio-materials.
Figure 6:
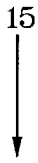
Figure 7:
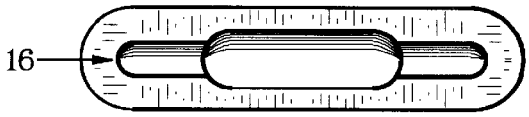
FIG. 7 is a bottom view of the FIG. 6 illustration.

For screwing the eye bolt 12, the hook bolt 13 and the centered hook bolt 14 in and out of hard building material that can include concrete, a fastener socket 15, shown in FIGS. 6–7, is provided with a fastener bay 16 having a laterally long portion to receive eye portions of the eye bolt 12 and a shorter but deeper portion to receive hook portions of the hook bolt 13 and the centered hook bolt 14. A socket-wrench connection 17 can be sized and shaped to receive a wrench socket and a socket-wrench handle that are not shown. The centered hook bolt 14 is provided for concentric wrenching and thread-fastening.

Concrete of building precipices can be set with the eye bolt 12, the hook bolt 13 and/or the centered hook bolt 14 therein or with bays to receive them. Optionally, the concrete can be drilled with a concrete bit on a motorized drill.

Figure 8:
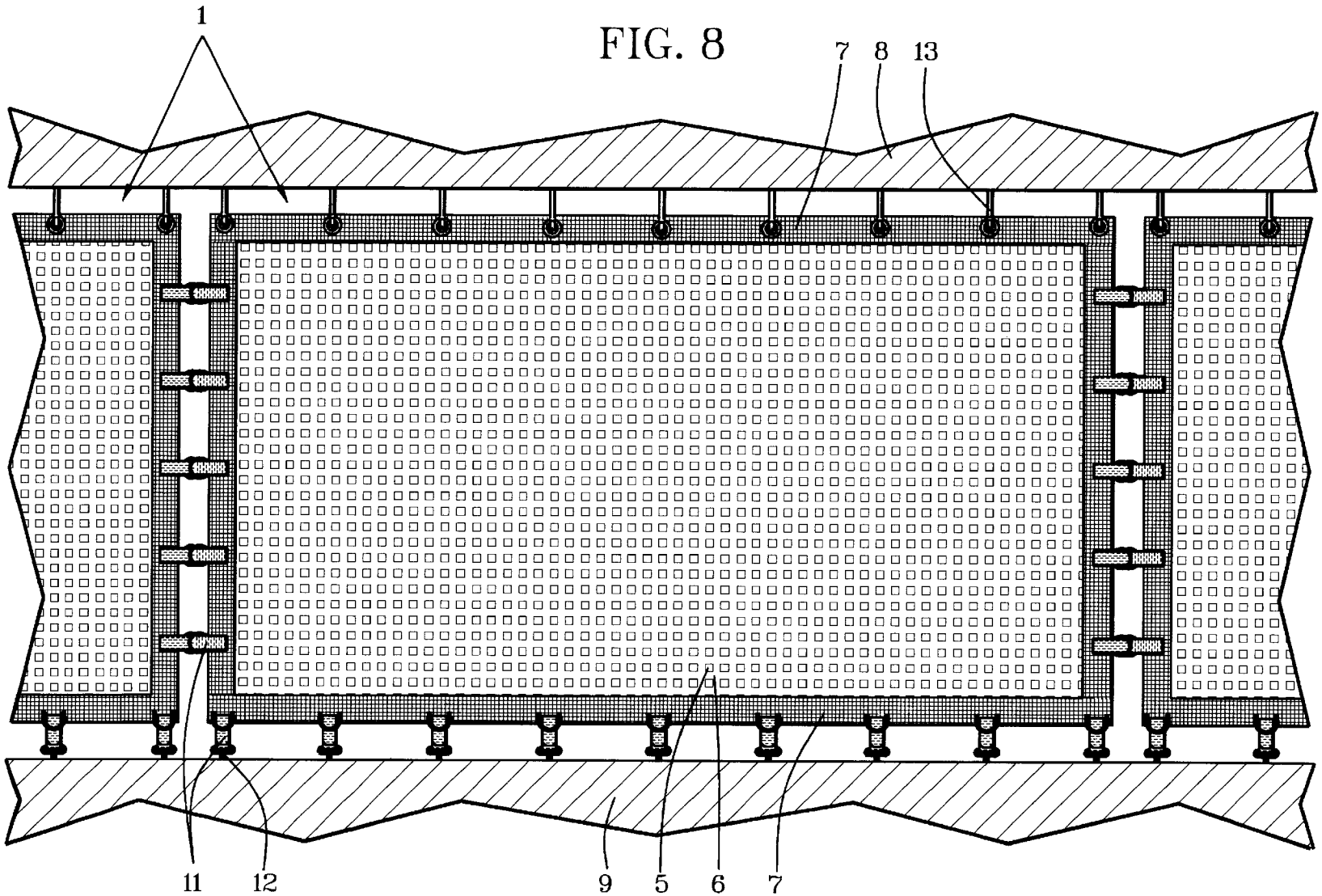
FIG. 8 is a partially cutaway front elevation view of a plurality of the construction safety screens covering a long precipice and attached end-to-end.
Figure 13:
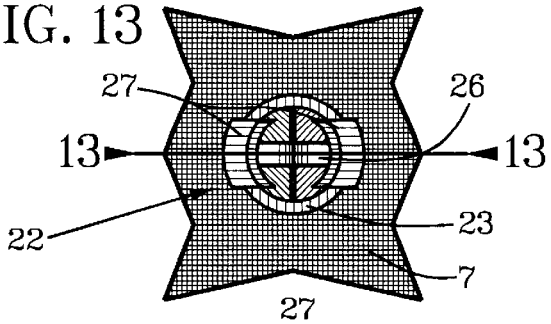
FIG. 13 is a fragmentary view of a potion of the fastening border having a buckle with optional quick disconnection shown from a top.
Figure 14:
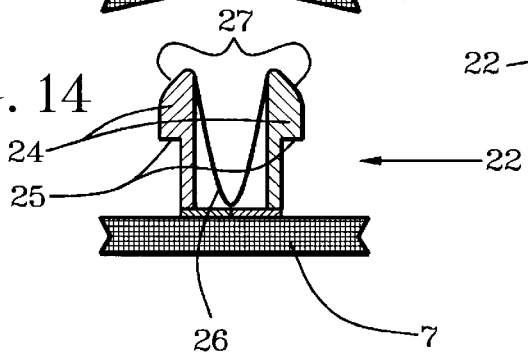
FIG. 14 is a section view of the FIG. 13 quick disconnection shown through section line 13—13 of FIG. 13.
Figure 15:
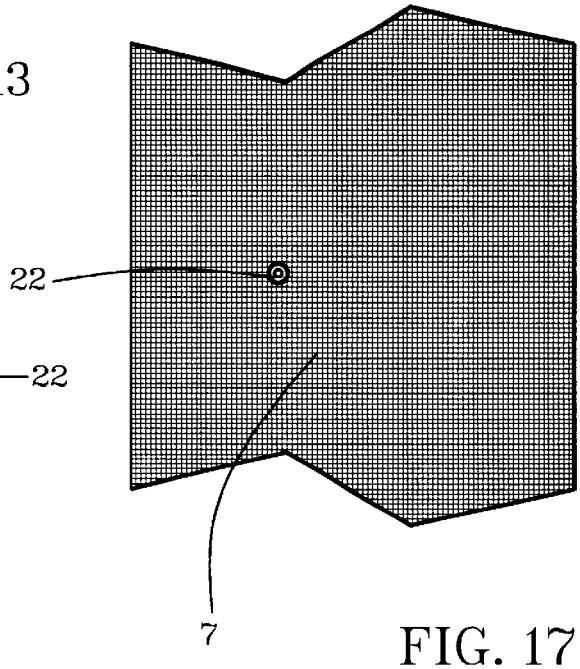
FIG. 15 is a fragmentary top view of the fastening border with the quick-disconnection.
Figure 16:
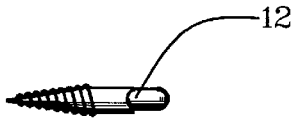
FIG. 16 is a side view of the eye bolt positioned to receive a section of a quick-disconnect line on which a quick disconnection is positioned.
Figure 17:
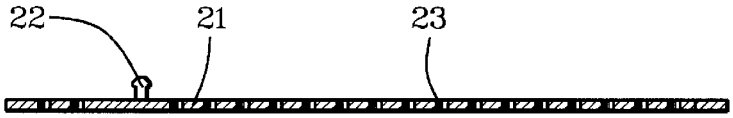
FIG. 17 is a partially cutaway side view of the quick-disconnect line on which a quick disconnection is positioned.
Figure 18:
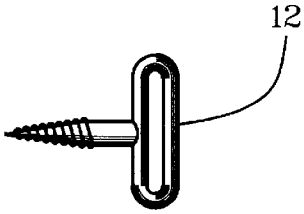
FIG. 18 is a front view of the eye bolt positioned to receive the quick-disconnect line.
Figure 19:
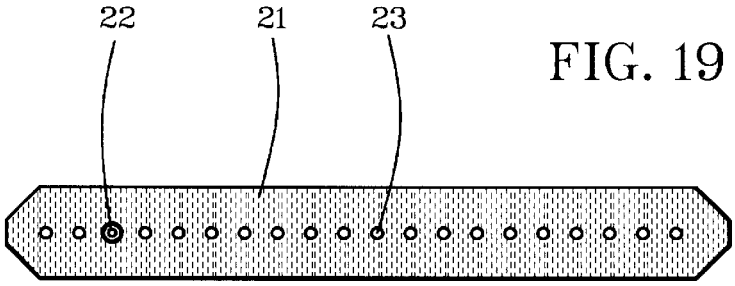
FIG. 19 is a top view of the quick-disconnect line.
Figure 20:
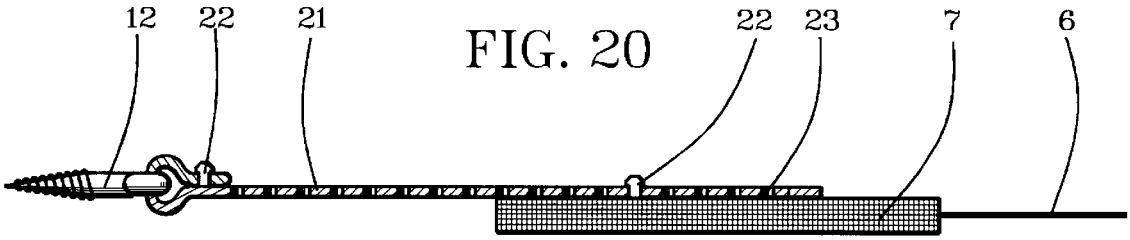
FIG. 20 is a partially cutaway side view of the eye bolt to which the quick-disconnect line is connected and with the quick-disconnect line connected to the fastening border with a quick disconnection on the fastening border.

As shown in FIG. 8, a plurality of the construction safety screens 1 can be joined end-to-end with attachment lines 11 that are buckled together, attached to the precipice top 8 with the hook bolts 13 or centered hook bolts 14 and attached to the precipice bottom 9 with the attachment lines 11 and the eye bolts 12.

Referring to FIGS. 2, 8 and 9–12, the attachment lines 11 can have length-adjustment attachment intermediate the eye bolt 12 and the fastening border 7 with double-ring buckles 18 that are attached to the fastening border 7. Optionally as shown in FIGS. 11–12, standard flat-strap buckles 19 can be used in combination with a strap orifice 20 in the fastening border 7. A first end of the attachment line 11 is attached to the eye bolt 12 and a second end is attached to the fastening border 7.

Preferably, the construction safety screen 1 has visibility coloration that includes yellow for the netting material 6, orange for the fastening border 7, pink for the attachment lines 11, blue for the buckles 18 and blue for the building-structure fasteners 12, 13, 14 and 28.

Referring to FIGS. 13–20, convenient and fast connection to and disconnection from the eye bolts 12 can be provided with quick-disconnect lines 21. The quick-disconnect lines 21 have first line ends attached to the building-structure fastener, which includes the eye bolt 12, with a quick disconnection 22 on the quick-disconnect line 21. A second end of the quick-disconnect line 21 is attached to the fastening border 7 with a quick disconnection 22 on the fastening border 7.

The quick disconnection 22 can include a spring-hook projection that spring-hooks into quick-disconnection eyes 23 that are suitably bordered apertures spaced apart along the quick-disconnect lines 21. The quick disconnection 22 includes double-point ratchets 24 that are juxtaposed with ratchet hooks 25 oppositely disposed and extended resiliently from the first line end of the quick-disconnect line 21 and from the fastening border 7 respectively to which they are attached. The double-point ratchets 24 are forced inwardly towards each other against spring force of preferably an outward-tension member 26 by insertion into the quick-disconnection eyes 23 which slide against closure inclines 27. The quick disconnections 22 are removed by finger-squeezing the double-point ratchets 24 together and pushing them out from the quick-disconnection eyes 23.

This allows fast, convenient and secure connection and disconnection that cannot be disconnected or loosened accidently.

Figure 21:
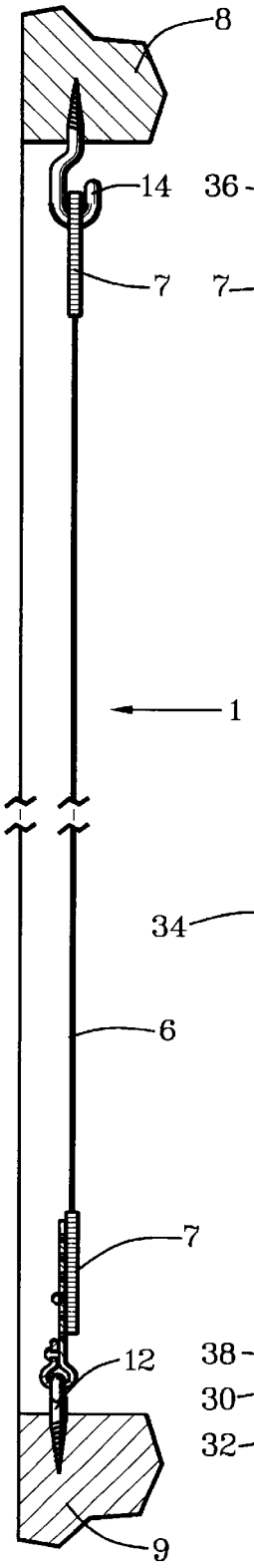
FIG. 21 is a fragmentary side view of a precipice that is a building aperture having a precipice top to which the hook bolt is attached and an precipice bottom to which the eye bolt is attached with the construction safety screen attached to them.
Figure 22:
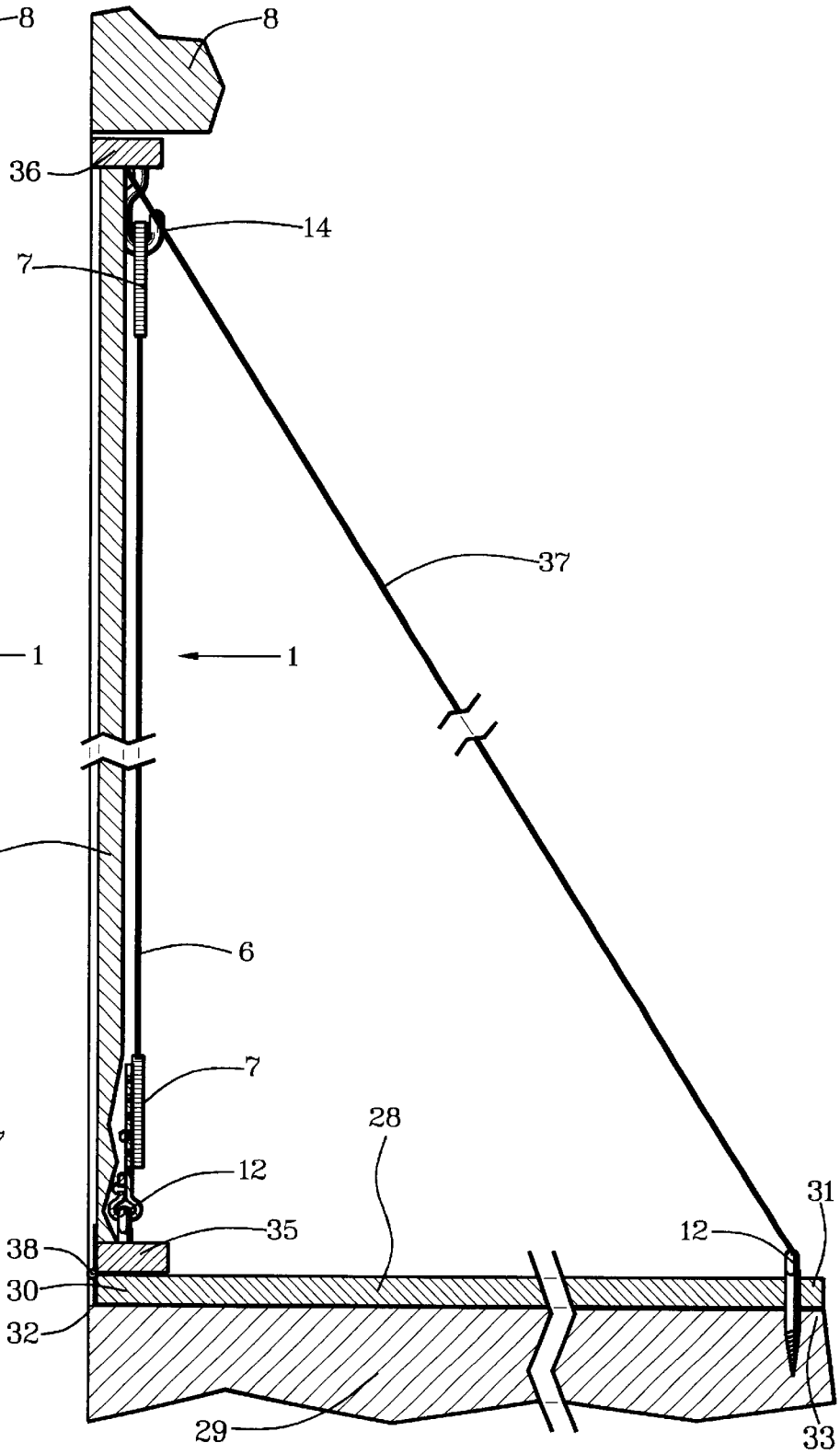
FIG. 22 is the fragmentary side view of the building aperture with a building-structure fastener that includes a base rod having an edge end proximate a precipice edge, an anchor end anchored to a precipice floor and a guy intermediate a frame top and the anchor end of the base rod.
Figure 23:
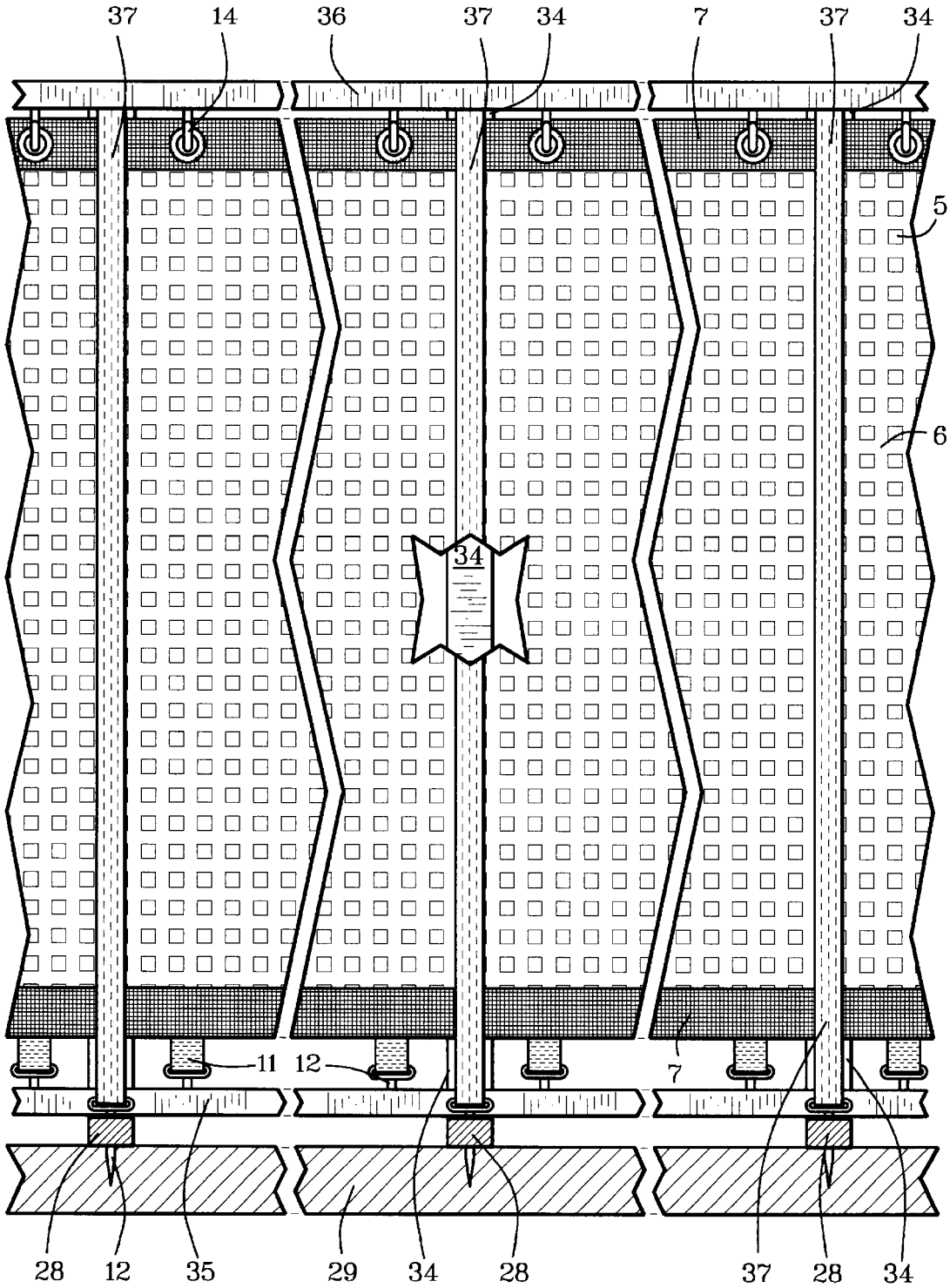
FIG. 23 is an attachment-side view of the FIG. 22 illustration.

Referring to FIGS. 21–23, optionally to attachment of the eye bolt 12 and the centered hook bolt 14 to edge portions of the building precipice depicted in FIG. 21, the building-structure fasteners can include a base rod 28 that rests on a precipice floor 29 as depicted in FIGS. 22–23. The base rod 28 includes an edge end 30 and an anchor end 31. The edge end 30 is positioned selectively proximate a precipice edge 32 and the anchor end 31 is positioned inwardly from the precipice edge 32 at proximate a floor-anchor position 33 where it is anchored preferably but not necessarily with the eye bolt 12. One or more net struts 34 are extended vertically upward from the edge end 30 of the base rod 28. A frame bottom 35 is extended horizontally from proximate a bottom of the net strut 34. A frame top 36 is extended horizontally from proximate a top of the net strut 34.

The fastening border 7 has a bottom edge that is attached to the frame bottom 35 and a top edge that is attached to the frame top 36. A guy 37, which can be a flexible line or a rigid member, is positioned intermediate a top end of the net strut 34 and the anchor end 31 of base rod 28 to brace the net strut 34, the construction safety screen 1 and framework to which it is attached from falling outwardly.

The net strut 34 can be attached to the base rod 28 with a hinge 38 for ease of reuse and storage.

A plurality of the base rods 28 and the net struts 34 can be employed for wide building precipices.

The edge end 30 of the base rod 28 can be positioned as close to or on either side of the precipice edge 32. This allows screening building precipices that do not have any structure or adequate structure at sides and tops to which the construction safety screen 1 can be anchored or attached directly. With the base rod 28 extended over the precipice edge 32, the net struts 34 can be oriented or tilted to position the construction safety screen 1 for catching individuals who fall from outsides of buildings when doing final or other outside work. This also allows walling of entire sides or side portions of buildings for protection against falling during outside or near-precipice work on buildings.

Figure 24:
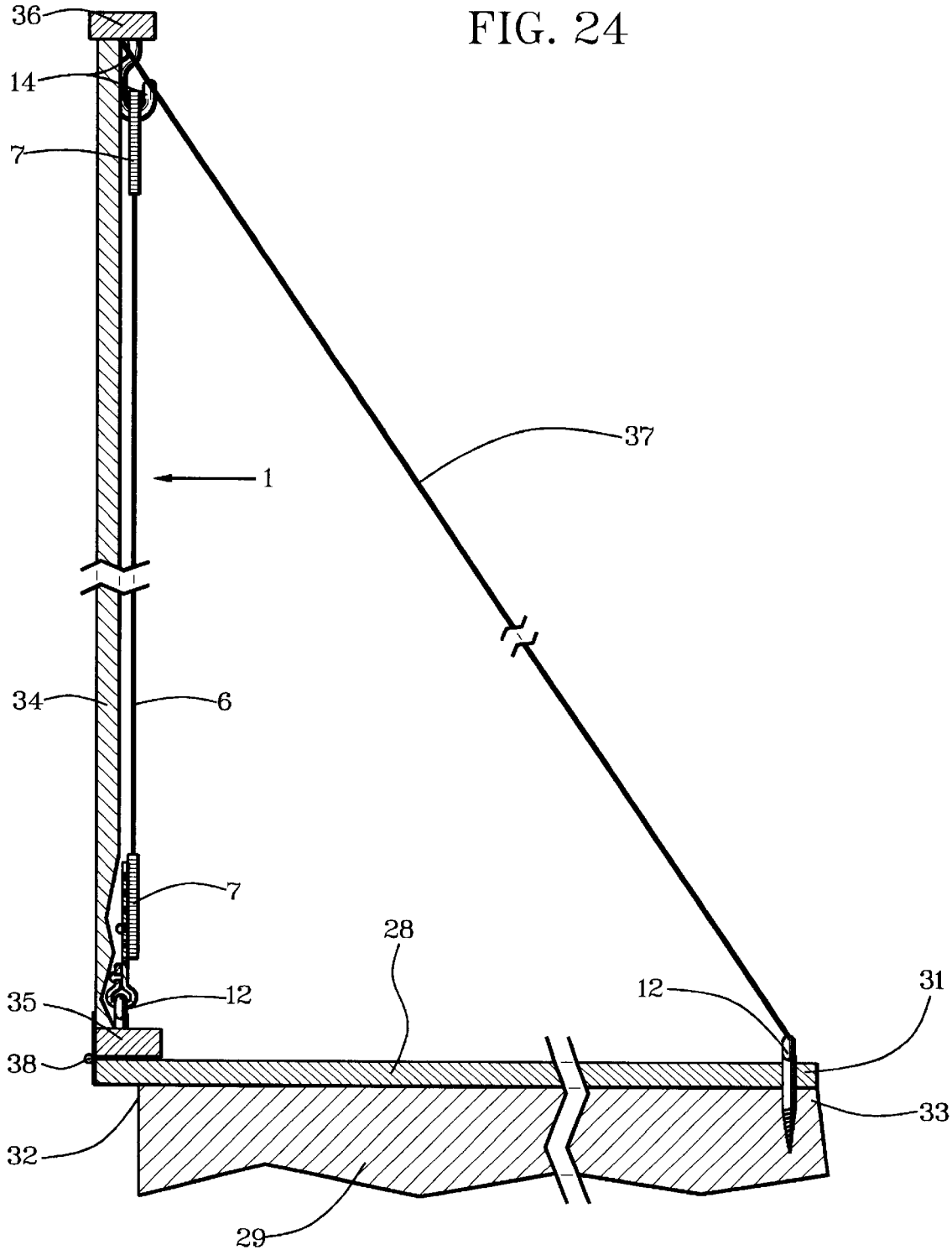
FIG. 24 is a partially cutaway side view of a precipice edge not having a precipice top or precipice side and with the base rod extended outwardly over the precipice edge.
Figure 25:
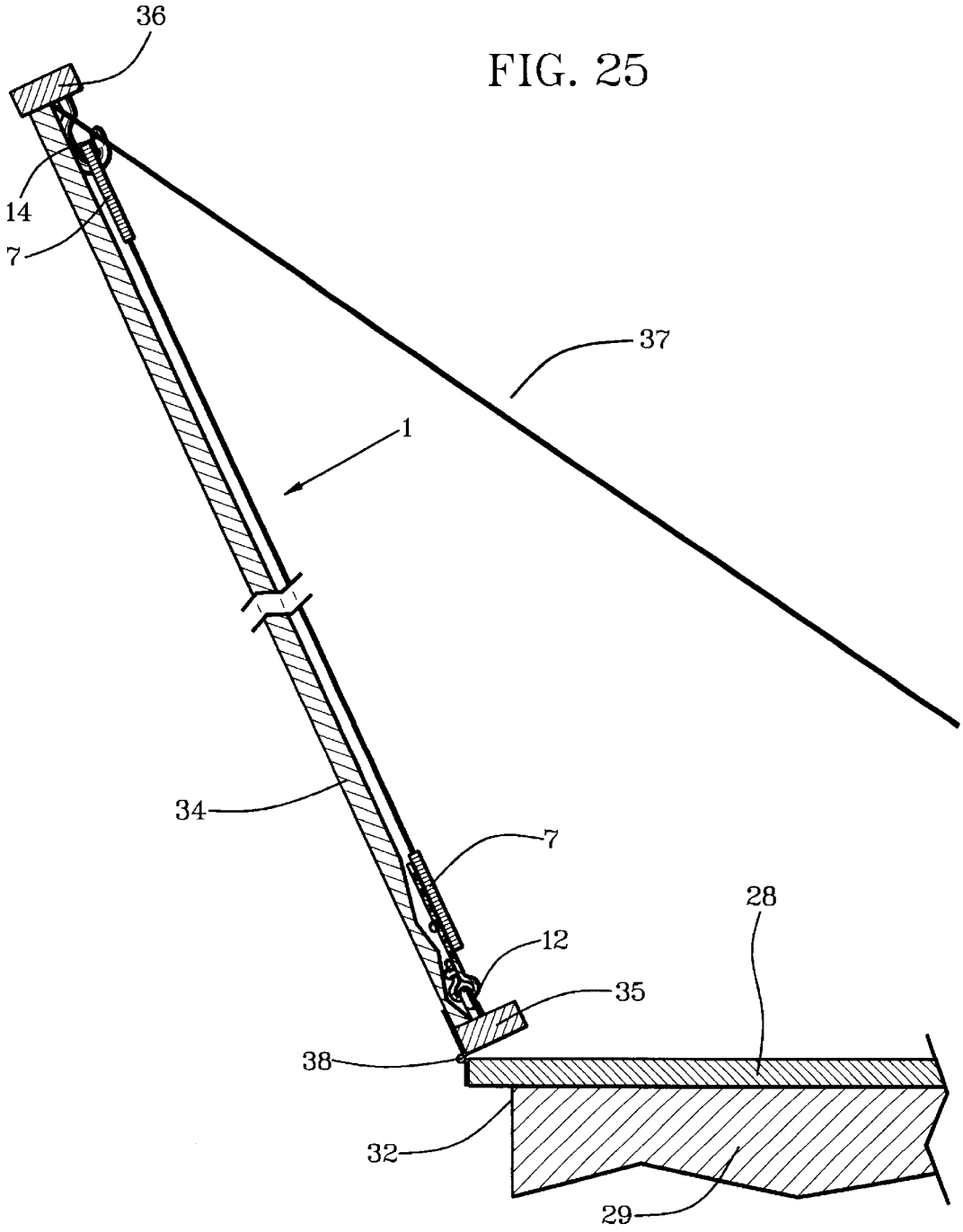
FIG. 25 is a partially cutaway side view of the precipice edge of the FIG. 24 illustration with the construction safety screen slanted from the base rod as fall protection of individuals doing outside finish work and other work at or near outside edges of buildings under construction.

Referring to FIGS. 24–25, the base rod 28 can be extended over precipice edges 32 which have only the precipice floor 29 for suitable attachment. Additionally with this embodiment, the construction safety screen 1 can be slanted as fall protection of individuals doing outside finish work at or near outside edges of buildings under construction. The guy 37 can support the frame top 36 and the net strut 34 in a select orientation with protective positioning at particularly dangerous building precipices.

Figure 26:
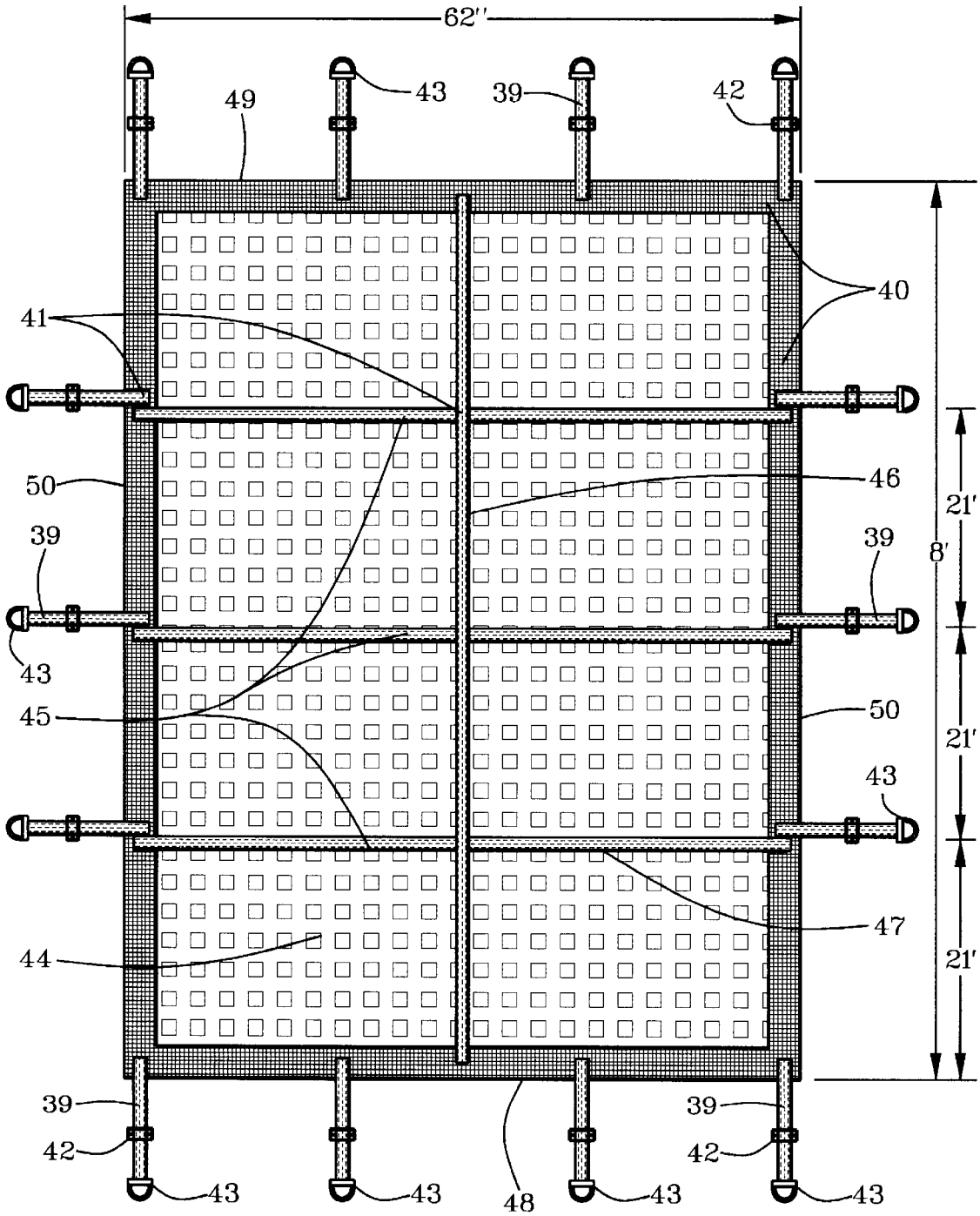
FIG. 26 is a front elevation view of another embodiment of the safety screen with reinforcement straps and snap ring fasteners.

FIG. 26 shows a safety screen wherein the fastening straps 39 are all adjustable. The safety screen is made of netting 44 surrounded by a net border 40 to which the adjustable fastening straps 39 are attached on all four sides, approximately every two feet, using a very strong box stitching 41. All straps 39 are adjustable by suing a common adjustment buckle 42.

Stitched to the end of all straps is a swivel snap ring 43 which makes the safety screen attachable and detachable by both sides. The snap ring 43 also connects each section of screen to other screens and allows the screen to cover different size openings.

Horizontal reinforcement straps 45 are stitched to the border 40 and a vertical reinforcement strap 46. The intermediate section of the horizontal reinforcement strap 47 between the border 40 and the vertical reinforcement strap 46 is not attached to the netting 44, so in the case that the bottom border 48 of the safety screen was not properly fastened or fastened at all and a worker fell horizontal reinforcement straps 45 will serve as a grab line. These reinforcement straps 45 also create the protection needed if the netting 44 itself was cut or torn. The reinforcement straps are located at the heights required to be in compliance with OSHA regulations. Even if the safety screen is not fastened at the bottom border 48 or at the top border 49, so long as the screen is fastened at the side borders 50, it is safe, strong and in compliance. This added feature also gives the worker the ability to detach the top border 44 of the safety screen and let the netting 44 fold over when the completion of upper portion of the work area has occurred and still be in compliance with current regulations.

The safety screen also may be fastened to steel beans without penetrating the steel. This is possible by attaching longer adjustable straps to the borders which then may be wrapped around the steel beams and attached by the snap rings 43 to a D-ring (not shown) attached to the border 40. Such a design may be necessary for steel erected structures where penetrations are prohibited, such as nuclear power plants.

Other features, such as zipper fasteners or snap-on plastic covers may also be used, particularly to provide protection in cold climates.

Figure 27:
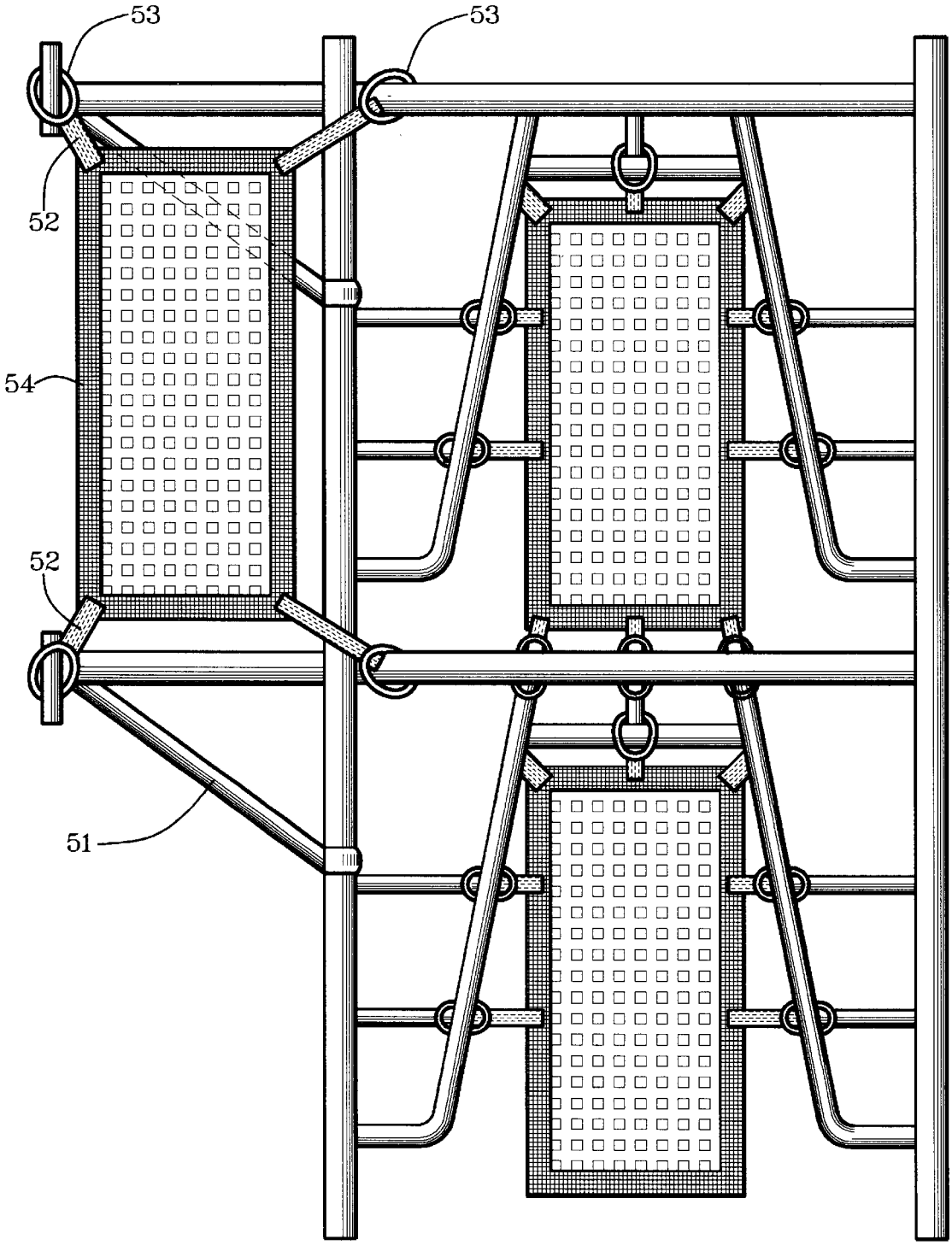
FIG. 27 is a front elevation view of the safety screen with snap ring fasteners being used on a scaffold.

The safety screen system of the present invention also provides vertical fall prevention in common construction scaffolding. As illustrated in FIG. 27, the safety screen may be installed at the end 51 of staging levels, attached by straps 52 and snap rings 53 operable by the border 54 surrounding the netting 55. The safety screen may also be attached to the end of outrigger work areas at each scaffold level by suing the same strap and snap ring fastening system. This same type of netting will also be installed inside the walk-thru area of the staging attached to the center supports of the scaffolding which provides fall prevention from a worker's feet to head along the entire working area. At the top level of scaffolding the safety screen may also be installed to provide a debris barrier as well as a brightly colored safety system which will quickly alert workers to an un-safe working area.

This product may also be installed in different sections of the scaffolding to provide easy access to scaffolding stairways and ladders and prevent falls while climbing and descending to the work areas. In addition, the safety screen also provide areas to attach signs to the netting 55, such as "Scaffold Ladder," "Stairway," "Caution-Men Working Above" and so forth.

A new and useful construction safety screen having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A construction safety system that is sized and shaped to wall precipices, predeterminedly against accidental falling of individuals and objects therefrom, comprising:

a construction safety screen having see-through apertures sized to resist passage of a human body and objects surrounded by netting material having strength to support weight of the human body predeterminedly;

a fastening border which surrounds the construction safety screen with border strength for fastening the construction safety screen to a structure predeterminedly;

fasteners that detachably attach the construction safety screen to predetermined structures proximate precipices;

attachment lines adapted to extend with adjustable length of extension intermediate a structure and the fastening border;

the fastening border, the fasteners and the attachment lines having predetermined composite strength and reliability of interconnection to restrain accidental falling of individuals and objects from precipices; and predetermined coloration of the construction safety screen, the fastening border and the attachment lines for visibility of fall-protective attachment of the construction safety screen to predetermined structure proximate precipices, wherein the attachment lines include predeterminedly quick-disconnect lines having first line ends attached to building-structure fasteners and second line ends attached to the fastening border;

the first line ends being attachable to the building-structure fasteners and the second line ends being attached to the fastening border with predetermined quick disconnections; and lengths of extension of the quick-disconnect lines intermediate the building-structure fasteners and the fastening border being adjustable with length of the quick-disconnect lines intermediate the quick disconnections on the quick-disconnect lines and the quick disconnections on the fastening border.

2. The construction safety system of claim 1 wherein:

the quick disconnections include double-point ratchets juxtaposed with ratchet hooks oppositely disposed and extended resiliently from the first line end;

the second line ends having quick-disconnection eyes into which the double-point ratchets are inserted for quick connection of the first line ends to the second line ends and out from which the double-point ratchets are removed for quick disconnection of the first line ends from the second line ends by squeezing the double-point ratchets together and pushing them out from the quick-disconnection eyes; and the quick-disconnection eyes are disposed consecutively along the second line ends at predetermined length-adjustment distances apart.

3. A construction safety system that is sized and shaped to wall precipices predeterminedly against accidental falling of individuals and objects therefrom, comprising:

the construction safety screen including see-through apertures sized to resist passage of a human body and objects and surrounded by netting material having strength to support weight of the human body predeterminedly;

a fastening border which surrounds the safety screen with border strength for fastening the construction safety screen to a structure predeterminedly;

fasteners that detachably attach the safety screen to predetermined structures proximate precipices;

attachment lines adapted to extend with adjustable length of extension intermediate a structure and the fastening border;

the fastening border, the fasteners and the attachment lines having predetermined composite strength and reliability of interconnection to restrain accidental falling of individuals and objects from precipices; and predetermined coloration of the construction safety screen, the fastening border and the attachment lines for visibility of fall-protective attachment of the construction safety screen to the predetermined structure proximate precipices; wherein, the precipices include an aperture the fasteners include swivel snap rings that attach the construction safety screen to the structure; and eye bolts attached to the structure having fastener threading that is anchored detachably to the aperture structure predeterminedly, and further comprising, a fastener socket having a fastener bay proximate a bay end and a socket-wrench connection on a wrench end;

the fastener bay being sized and shaped to receive an eye portion of the eye bolts;

the fastener bay being sized and shaped to receive a hook portion of the hook bolts; and the socket-wrench connection being sized and shaped to receive a predetermined wrench socket for rotation of the fastener socket with the wrench socket and a socket-wrench handle attached thereto;

eye bolts attached to the structure having fastener threading that is anchored detachably to the aperture structure predeterminedly.

4. A construction safety system that is sized and shaped to wall precipices predeterminedly against accidental falling of individuals and objects therefrom, comprising:

a construction safety screen having see-through apertures sized to resist passage of a human body surrounded by netting material having strength to support weight of the human body predeterminedly;

a fastening border which surrounds the construction safety screen with border strength for fastening the construction safety screen to a structure predeterminedly;

fasteners that detachably attach the construction safety screen to predetermined structures proximate precipices;

attachment lines extended with adjustable length of extension intermediate the structure and the fastening border;

the fastening border, the fasteners and the attachment lines having predetermined composite strength and reliability of interconnection to restrain accidental falling of individuals and objects from precipices; and predetermined coloration of the construction safety screen, the fastening border and the attachment lines for visibility of fall-protective attachment of the construction safety screen to the predetermined structure proximate precipices, wherein the precipice includes a building aperture;

building-structure fasteners which include at least one base rod on a precipice floor;

the base rod includes an edge end and an anchor end;

the edge end of the base rod is positioned proximate an precipice edge;

the anchor end of the base rod is positioned inward predeterminedly from the precipice edge to proximate a floor-anchor position on the precipice floor;

the anchor end of the base rod is anchored to the precipice floor;

at least one net strut is extended upward vertically from the edge end of the base rod;

a frame bottom is extended horizontally from proximate a bottom of the net strut;

a frame top is extended horizontally from proximate a top of the net strut;

the fastening border of the construction safety screen has a top edge that is attached to the frame top;

the fastening border of the construction safety screen has a bottom edge that is attached to the frame bottom; and a guy is positioned intermediate a top end of the net strut and the anchor end of the base rod to brace the net strut and the construction safety screen from falling outwardly.

5. The construction safety system of claim 4 wherein:

the net strut is attached to the base rod with a hinge.

6. The construction safety system of claim 4 wherein:

the at least one base rod includes a plurality of base rods;

the net strut includes a plurality of net struts; and the construction safety screen is framed by the plurality of net struts, the frame top and the frame bottom.

7. A construction safety system that is sized and shaped to wall open precipices predeterminedly against accidental falling of individuals and objects therefrom, comprising:

the open precipices are from a group that includes windows, stairwells, elevator shafts, building edges, balconies, floors and scaffolding;

the construction safety system having see-through apertures sized to screen against passage of a human body and objects and surrounded by netting material having strength to support weight of the human body predeterminedly;

a fastening border which surrounds the safety screen with border strength for fastening the construction safety screen to building-structure fasteners and frame fasteners predeterminedly;

building structure fasteners which include attachment rods attached detachably to a precipice floor;

attachment lines extended with adjustable length of extension intermediate the building structure fasteners and the fastening border;

the fastening border, the building-structure fasteners and the attachment lines having predetermined composite strength and reliability of interconnection to restrain accidental falling of individuals and objects from the precipice;

predetermined coloration of the construction safety screen, the fastening border and the attachment lines for visibility of fall-protective attachment of the construction safety screen to the predetermined building structure proximate the precipice;

the base rod includes an edge end and an anchor end;

the edge end of the base rod is positioned selectively proximate a precipice edge;

the anchor end of the base rod is positioned inward predeterminedly from the precipice edge to proximate a floor-anchor position on the precipice floor;

the anchor end of the base rod is anchored to the precipice floor;

at least one net strut is extended upward vertically from the edge end of the base rod;

a frame bottom is extended horizontally from proximate a bottom of the net strut;

a frame top is extended horizontally from proximate a top of the net strut;

the fastening border of the construction safety screen has a top edge that is attached to the frame top;

the fastening border of the construction safety screen has a bottom edge that is attached to the frame bottom; and a guy is positioned intermediate a top end of the net strut and the anchor end of the base rod to brace the net strut and the construction safety screen from falling.

8. The construction safety system of claim 7 wherein:

the net strut is attached to the base rod with a hinge for storage and for select verticality of orientation.

9. The construction safety system of claim 8 wherein:

the edge end of the base rod is positioned outward selectively from the precipice edge; and the net strut and the construction safety screen are slanted outwardly and upwardly.

10. The construction safety system of claim 7 wherein:

the at least one base rod includes a plurality of base rods;

the net strut includes a plurality of net struts; and the construction safety screen is framed by the plurality of net struts, the frame top and the frame bottom.

11. The construction safety system of claim 7 wherein:

the edge end of the base rod, the net strut and the construction safety screen are positioned outward selectively from the precipice edge.

12. The construction safety system of claim 7 wherein:

the edge end of the base rod, the net strut and the construction safety screen are positioned inward selectively from the precipice edge.

* * * * *